United States Patent [19]

Sekine

[11] 4,240,154

[45] Dec. 16, 1980

[54] ELECTRONIC DIGITAL STOP WATCH

[75] Inventor: Mitsuo Sekine, Tokorozawa, Japan

[73] Assignee: Citizen Watch Co., Ltd., Tokyo, Japan

[21] Appl. No.: 920,443

[22] Filed: Jun. 29, 1978

[30] Foreign Application Priority Data

Jul. 8, 1977 [JP] Japan ..... 52/81804

[51] Int. Cl.[3] ..... G04B 23/02; G04C 21/00; G04F 8/00

[52] U.S. Cl. ..... 368/72; 368/113

[58] Field of Search ..... 58/19 R, 16.5, 21.12, 58/21.13, 57.5, 38 R, 39 S, 74, 145 D, 152 R, 152 B; 235/92 T, 92 GA; 364/569; 340/309.1, 384 E

[56] References Cited

U.S. PATENT DOCUMENTS

| | | | |
|---|---|---|---|
| 3,813,533 | 5/1974 | Cone et al. | 58/152 R X |
| 3,834,153 | 9/1974 | Yoda et al. | 58/38 |
| 3,980,868 | 9/1976 | Thompson | 235/92 T |
| 4,099,371 | 7/1978 | Mochizuki et al. | 58/22.7 |
| 4,104,862 | 8/1978 | Yamazaki et al. | 58/38 R |
| 4,104,865 | 8/1978 | Sasaki | 58/58 |
| 4,122,660 | 10/1978 | Cananan | 58/16.5 |

*Primary Examiner*—Vit W. Miska

*Attorney, Agent, or Firm*—Sherman & Shalloway

[57] ABSTRACT

An electronic digital stop watch including means for generating a time standard signal, a display device for indicating the time lapsed from the start operation and alarm control means provided for presetting a desired alarm time and for generating an audible alarm signal when the lapsed time becomes equal to the preset time.

18 Claims, 3 Drawing Figures

ELECTRONIC DIGITAL STOP WATCH

BACKGROUND OF THE INVENTION

The present invention is related to an electronic digital stop watch which is designed to measure duration of time by an electronic means from the moment the watch is triggered to start its time-keeping operation, and which has a function to display the time from the moment the watch is triggered to start its time-keeping operation.

Stop watches are useful timepieces for highly precisely measuring the times of various movements and are widely used for measuring the times of athletic events. In many cases, for example, when used for measuring the times of track events, the stop watches are used in a manner that a start button of the stop watch is pushed simultaneously with the sign of start to trigger its time-keeping function, and the start button is pushed again when a runner reaches the goal to stop the operation of a time-keeping mechanism, whereby the stop watch displays the duration of time which it has measured. So far as they are used in the aforementioned manner, the stop watches irrespective of whether they are of a mechanical type or of an electronic type, do not impose any particular inconvenience. However, when ordinary stop watches are used for measuring the times of events such as soccer, basketball, and the like which are carried out within predetermined periods of time, the umpires must frequently consult the display of the stop watch as the remaining duration of time approaches the finish time to know the exact finish time. The consultation of the stop watch will further involve difficulty in case there developed loss times due to violation of the rules during the event. This difficulty inherent in the conventional stop watches also holds true when stop watches are used for other applications than the athletic events, such as measurement of times associated with physical and chemical experiments which are often carried out within predetermined periods of time.

SUMMARY OF THE INVENTION

A primary object of the present invention is to provide an electronic digital stop watch which produces audible alarm when a preset period of time has passed from the moment of start. The alarm sound enables the user of the stop watch to know that a predetermined period of time has passed without forcing him to look at the display of the stop watch, and therefore, makes it easy to control the time.

Another object of the present invention is to provide an electronic digital stop watch which produces pre-alarm sound one or more times prior to producing the normal alarm sound.

Other objects and features of the invention will be fully understood from the following description with reference to the accompanying drawings.

DETAILED DESCRIPTION OF THE PREFERRED EMBODIMENTS

Figure 1:
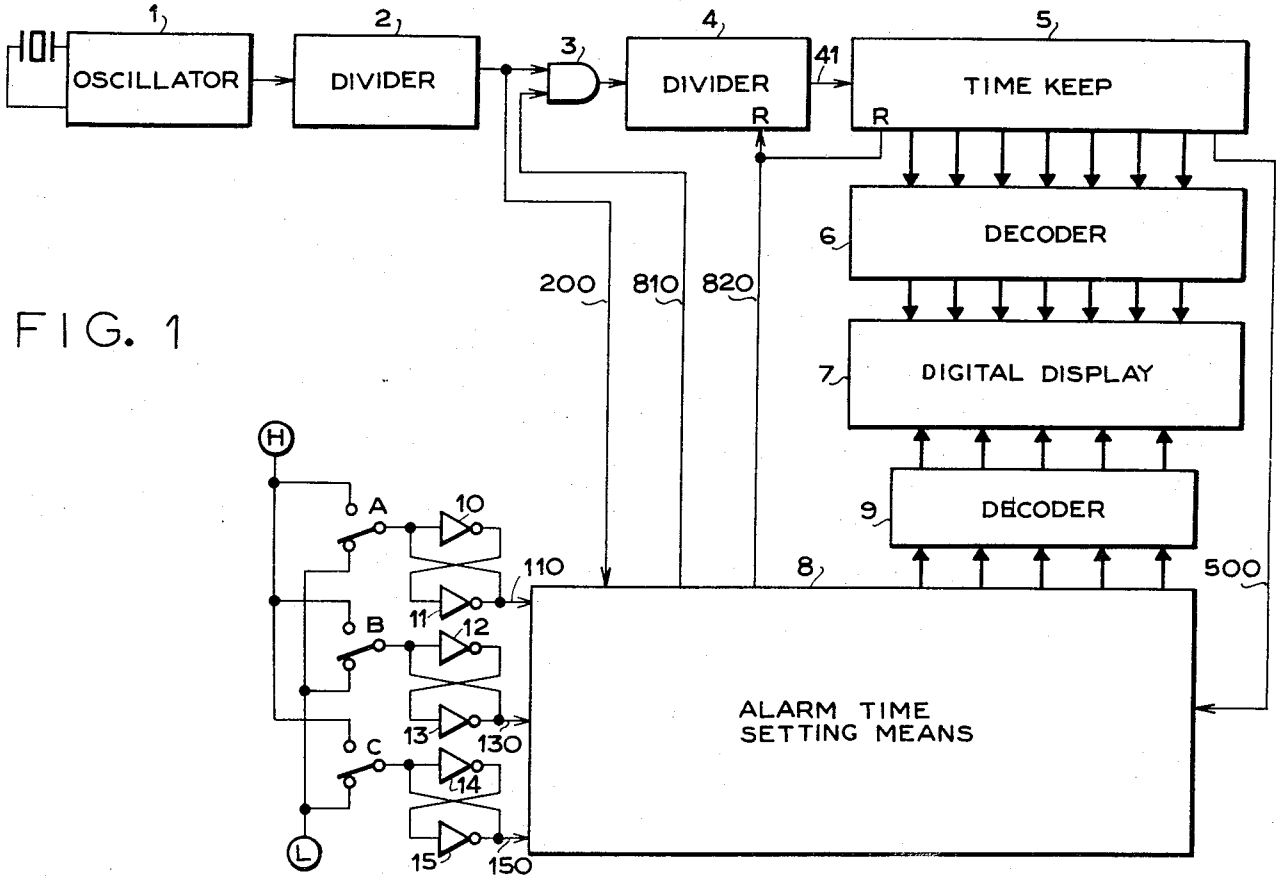
FIG. 1 is a block diagram showing various elements and their connections constituting a stop watch according to an embodiment of the present invention.

Referring to FIG. 1 which is a block diagram showing a circuit according to an embodiment of the present invention, reference numeral 1 represents a time standard signal generator, 2 a frequency-divider stage for dividing time standard signals into signals 200 of a predetermined frequency, 3 a two-input AND gate which controls said signals 200 by means of a signal 810, and reference numeral 4 represents a frequency-divider stage for dividing the frequency of an output signal of the AND gate 3 into a frequency of a time unit signal 41 which, according to the embodiment of the present invention, has been set at 100 Hz. Reference numeral 5 designates a time-keeping mechanism, 6 a decoder for converting the contents of said time-keeping mechanism 5 into segment signals, and reference numeral 7 denotes a digital display. An alarm time control means includes an alarm time setting mechanism 8 which, according to the embodiment of the present invention, comprises an alarm time setting means, means for detecting the moment when the contents of said time-keeping mechanism and an alarm time setting state have created a particular relation, a mechanism for producing alarm signals in a form suitable for the desired form of alarming, and an alarming device. Reference numeral 9 represents a decoder for converting the contents of time setting in the alarm time setting mechanism into segment signals. Reference numerals 10 to 15 designate inverters wherein a switch A and inverters 10, 11 serve as input mechanisms for setting the start, stop and time. A switch B, and inverters 12, 13 serve as input mechanisms for resetting and selecting the circuits. A switch C, and inverters 14, 15 in the embodiment of the present invention are used for stopping the alarming sound. The switches A, B and C are self-restoring-type ones which are normally maintained in a low-potential side (hereinafter referred to as L level), and after manually connected to a high-potential side (hereinafter referred to as H level), return to the L level when released. The inverters 10, 11, 12, 13, 14 and 15 further act to prevent the chattering of the switches A, B and C. Referring to the outputs of the alarm time setting mechanism 8, reference numeral 810 designates a start-stop signal and 820 designates a reset signal. A signal 500 applied to the alarm time setting mechanism 8 has a frequency of 1 Hz, i.e., a 1-second signal.

Figure 2:
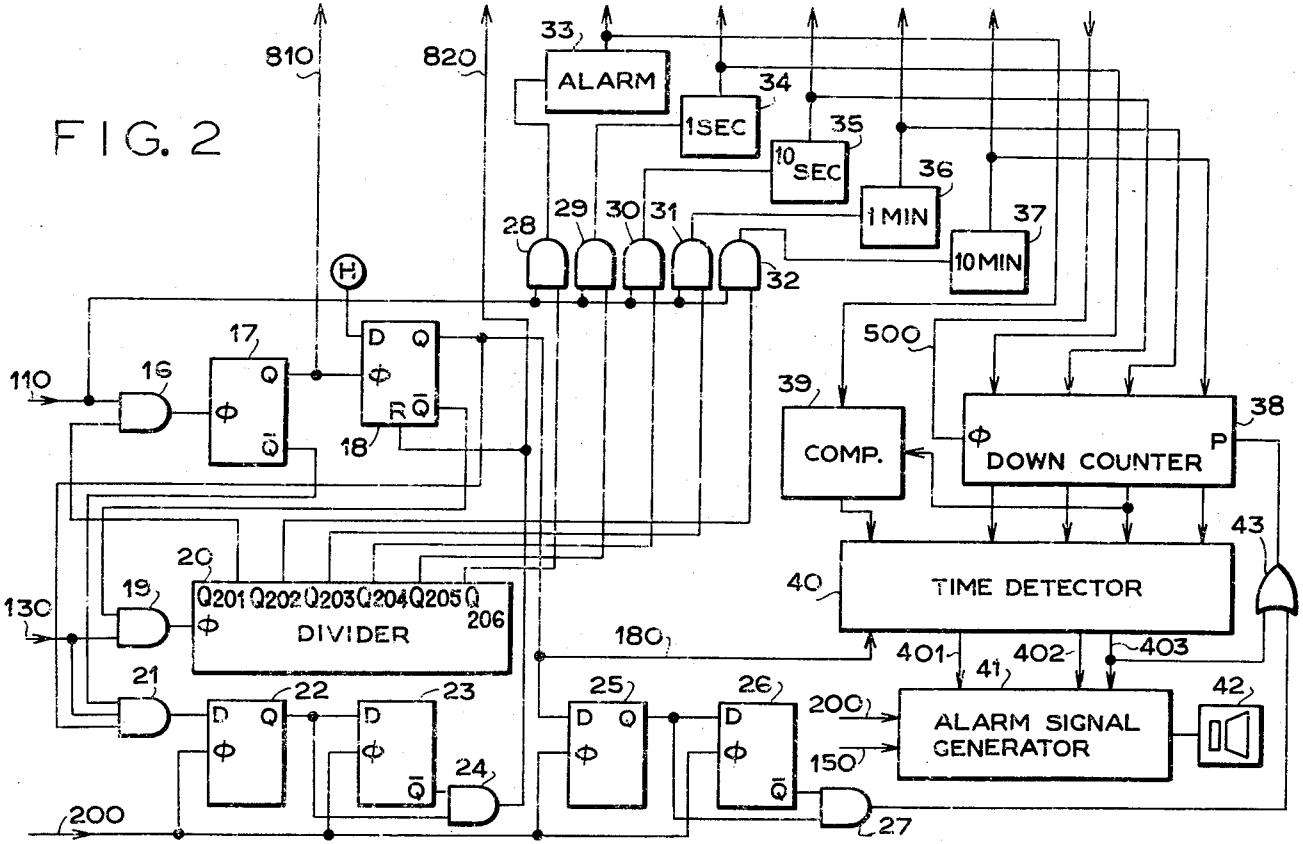
FIG. 2 is a block diagram showing construction of a time-setting mechanism used for the stop watch of FIG. 1.

FIG. 2 shows a circuit of a time setting mechanism, in which reference numerals 16, 19, 24, 27, 28, 29, 30, 31 and 32 represent two-input AND gates, reference numeral 21 designates a three-input AND gate, 17 a toggle flip-flop (hereinafter referred to as T-FF), 20 a divide-by-6 frequency divider, and reference numerals 18, 22, 23, 25 and 26 denote D-type flip-flops (hereinafter referred to as D-FF). Reference numerals 33 to 37 designate time setting mechanisms and alarm setting mechanisms of from 10-minute digit to 1-minute digit. Further, reference numeral 38 designates a presettable down counter. To the presettable down counter 38 are applied the outputs of said time setting mechanisms 34 to 37, and to its input terminal $\phi$ is applied the 1-second signal 500 shown in FIG. 1. Reference numeral 39 denotes a circuit for comparing the set state of said alarm setting mechanism 33 with the 1-minute digit output of the presettable down counter 38. By this circuit 39, the value set to the alarm setting mechanism 33 is produced prior to its normal time maintaining a time interval of 1 minute. It should be noted here that the alarm can also be set for other digits. Reference numeral 40 stands for a mechanism for detecting the normal time and forecast time, 401 a forecast output for the alarm setting, 402 a forecast output produced prior to a normal time by a predetermined period of time, and reference numeral 403 represents an output at a normal time. Here, the presettable down counter 38, the comparator circuit 39 and the detector mechanism 40 serve as a mechanism for detecting the moment when the time-keeping output and the time-setting contents established a particular relation. This function can also be attained by various other systems.

Reference numeral 41 represents an alarm signal generator for varying the form of alarming, and is equipped with a drive circuit for energizing an electro-mechanical converter, i.e., a sound-producing mechanism 42. Reference numeral 43 represents a two-input OR gate.

The operation of the device is illustrated below. For the purpose of easy understanding, in the following description, T-FF 17 and D-FF's 18, 22, 23, 25, 26, and the divide-by-6 frequency divider 20 are triggered by a rising signal applied to the input terminal $\phi$, and in this case, the D-FF's 18, 22, 25, and 26 produce from their output terminals Q the outputs of the same potential as that of the input D and produce from their terminals $\overline{Q}$ the outputs of a reversed potential. Furthermore, depending upon a signal applied to the input terminal $\phi$, any one of the outputs $Q_{201}$ to $Q_{206}$ of the divide-by-6 frequency divider 20 acquires the H level and the other outputs acquire the L level. The order by which the output acquires the H level proceeds from the output $Q_{201}$ toward the output $Q_{206}$ successively and the D-FF 18 is reset by a signal applied to the input terminal R while said signal is acquiring the H level. The presettable down counter 38 is preset by a signal applied to the input terminal P while said signal is acquiring the H level. Among the circuits shown in FIG. 2, the portion consisting of D-FF's 22, 23 and AND gate 24, and the portion consisting of D-FF's 25, 26 and AND gate 27 are commonly employed mechanisms. The former portion represents a reset signal generator and the latter portion represents a preset signal generator. The two portions produce at their AND gate terminals the signals H corresponding to one cycle of the signal 200 when a signal H is applied to the input terminals D of the D-FF's 22 and 25.

As an initial state, let it be supposed that the outputs Q of T-FF 17 and D-FF 18, and the outputs $Q_{202}$ to $Q_{206}$ of the divide-by-6 frequency divider 20 are all in the L level. Let it also be supposed that the outputs $\overline{Q}$ of T-FF 17 and D-FF 18 and the output $Q_{201}$ of the divide-by-6 frequency divider 20 are all in the H level.

In this state, if the switch B shown in FIG. 1 is tilted towards the side H, the output 130 acquires the H level, and one input terminal of the AND gate 19 and the second input terminal of the AND gate 21 acquire the H level. To the third input terminal of the AND gate 21 is applied an output Q of D-FF 18. Since the output Q is of L level, the output of the AND gate 21 acquires the L level irrespective of the output 130. The output $\overline{Q}$ of D-FF 18 is also applied to the other input terminal of the AND gate 19. Since the output $\overline{Q}$ is of the H level, the output of the AND gate 19 acquires the H level. The divide-by-6 frequency divider 20 is then operated so that the output $Q_{201}$ acquires the L level and the output $Q_{202}$ acquires the H level. At this moment, since the output $Q_{201}$ has been applied to one input terminal of the AND gate 16, the output of the AND gate 16 is maintained in the L level even though the signal 110 is changed by the switch A. This establishes a time setting state. That is, as the output $Q_{202}$ acquires the H level, the AND gate 32 is rendered conductive, whereby a signal same as the signal 110 obtained from the switch A is produced by the AND gate 32. Accordingly, the setpoint value of the 10-minute digit setting mechanism 37 increases for every operation of the switch A. After the 10-minute digit has been set, if the switch B is inclined toward the H level, the divide-by-6 frequency divider 20 is operated again, whereby the output $Q_{202}$ acquires the L level and the output $Q_{203}$ acquires the H level. Therefore, the AND gate 32 is rendered non-conductive and the AND gate 31 conductive. A 1-minute digit is then set by the signal 110 obtained by the switch A. Thus, by manipulating the switches A and B, it is possible to successively set the time from the 10-minute digit toward the 1-second digit as well as to set the alarming. The time setting mechanism employed here may be one that is often used for the circuits of timepieces.

After the setting of time has been finished, i.e., when the divide-by-6 frequency divider 20 is in an initial state, the measurement of time is commenced. In this case, the time-keeping operation is started by tilting the switch A toward the H level only for a short period of time. That is, to one input terminal of the AND gate 16 is applied the output $Q_{201}$ of the divide-by-6 frequency divider 20 which is in the H level, whereby the AND gate 16 is rendered conductive, and the output same as the signal 110 obtained by the switch A is produced from the AND gate 16. The T-FF 17 is then operated to produce the output Q of the H level and the output $\overline{Q}$ of the L level. The D-FF 18 is also operated to produce the output Q of the H level and the output $\overline{Q}$ of the L level. The output $\overline{Q}$ of the L level produced by the D-FF 18 renders the AND gate 19 non-conductive; the output of the AND gate 19 remains in the L level no matter how the signal 130 is changed by the switch B. The divide-by-6 frequency divider 20 does not operate. On the other hand, the output Q of the H level produced by the D-FF 18 causes the preset signal generator composed of D-FF's 25, 26 and AND gate 27 to produce a preset signal which is applied to one input terminal of the OR gate 43. The output of the OR gate 43 acquires the H level, and the presettable down counter 38 is preset to said value of time setting to perform the count-down operation successively by means of 1-second signals 500. The output Q of the H level produced by the T-FF 17 also causes and AND gate 3 of FIG. 1 to be conductive, so that the output 200 of a predetermined frequency of the frequency divider 2 is applied to the frequency divider 4 to commence the time-keeping operation. To stop the time-keeping operation, the switch A should be tilted again toward the H level. This causes the output of the AND gate 16 to be of the H level, whereby the T-FF 17 is operated such that the output Q acquires the L level and the output $\overline{Q}$ acquires the H level thereby to stop the time-keeping operation. Thereafter, if the switch A is tilted again toward the H level, the output of the AND gate 16 acquires the H level, the T-FF 17 is operated again and the output Q acquires the H level to start again the time-keeping operation.

Figure 3:
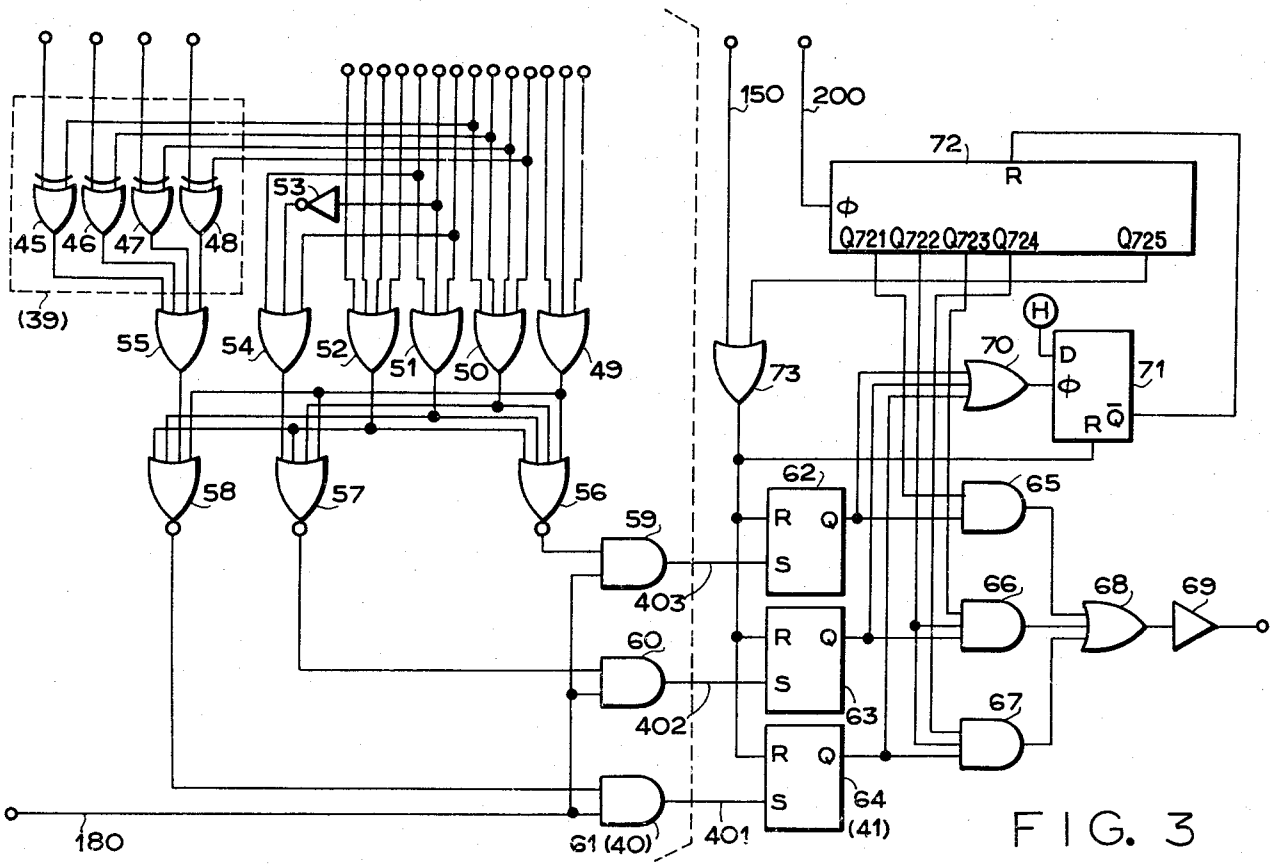
FIG. 3 is a block diagram showing a comparator circuit and a detector circuit employed in the time-setting mechanism of FIG. 2.

The alarm circuit will be described below. The circuits shown in FIG. 3 represent the comparator circuit 39, detector mechanism 40 and alarm signal generator 41 shown in FIG. 2. Here, the comparator circuit 39 is made up of Exclusive-OR-gates (hereinafter referred to as Ex-OR gates) 45 to 48. The detector mechanism 40 is designed to detect whether the digits from 10-minute digit to 1-second digit of the presettable down counter 38 are all zero or not at normal time. The 10-minute digit is produced by a three-input OR gate 49, the 1-minute digit is produced by a four-input OR gate 50, the 10-second digit is produced by an OR gate 51, and the 1-second digit is produced by an OR gate 52. These outputs are applied to the input terminals of a four-input NOR gate 56. At the normal time, the inputs to the NOR gate 56 will all be of the L level, and the NOR gate 56 produces the output of the H level only for this normal moment of time.

To produce the pre-alarm prior to the normal time by a predetermined period of time, an inverter 53 and an OR gate 54 according to FIG. 3 constitute a setup which produces a pre-alarming sound always 20 seconds prior to the normal time. This can be arbitrarily selected depending upon the requirements. The output of the OR gate 54, the output of the OR gate 49 which detects the 10-minute digit, the output of the OR gate 50 which detects the 1-minutes digit, and the output of the OR gate 52 which detects the 1-second digit, are all applied to the input terminals of the NOR gate 57. By this setup, the alarm is always produced 20 seconds prior to the normal time.

The alarming sound set by the alarm setting mechanism 33 is produced by applying the outputs of the comparator circuit 39 composed of a group of said Ex-OR gates to the input terminals of the OR gate 55, and applying the output of the OR gate 55, the output of the OR gate 49 for detecting said 10-minute digit, the output of the OR gate 51 for detecting the 10-second digit and the output of the OR gate 52 for detecting the 1-second digit to the input terminals of the NOR gate 58. The outputs of these NOR gates 56, 57 and 58 are applied to the input terminals of one side of the AND gates 59, 60 and 61. To the input terminals of the other side of the AND gates 59, 60 and 61 is applied the signal 180 which is an output Q of the D-FF 18 shown in FIG. 2. This output Q acquires the L level when the time is being set, and acquires the H level when the time-keeping operation is being carried out. The output Q therefore inhibits the alarming when the time is being set, and serves to produce the alarming only when the time-keeping operation is being carried out. In the foregoing was mentioned a setup of the detector mechanism 40 which produces outputs 401 to 403 as outputs of AND gates 59 to 61.

The setup of the alarm signal generator will be described below. The aforesaid detector mechanism 40 produces outputs 401 to 403 which are fed to the input terminals S of RS flip-flops (hereinafter referred to as RS-FF) 62, 63 and 64. The RS-FF's are composed of NOR gates and produce an output Q of the H level when a signal of the H level is applied to the input terminal S and produces the output Q of the L level when a signal of the H level is applied to the input terminal R. The output Q of the RS-FF 62 is fed to one input terminal of the AND gate 65 and to a first input terminal of an OR gate 70. The output Q of the RS-FF 63 is fed to a first input terminal of an AND gate 66 and to a second input terminal of an OR gate 70. The output Q of the RS-FF 64 is fed to a first input terminal of an AND gate 67 and to a third input terminal of an OR gate 70. The output of the OR gate 70 is fed to an input terminal $\phi$ of a D-FF 71 which is the same as the D-FF 18 shown in FIG. 2. The output $\overline{Q}$ of the D-FF 71 is fed to an input terminal R of a frequency divider 72. To the input $\phi$ of the frequency divider 72 is also fed the signal 200. The frequency divider 72 produces outputs $Q_{721}$ to $Q_{725}$. The outputs $Q_{721}$ and $Q_{722}$ are used to produce alarming frequencies. The output $Q_{721}$ has a frequency higher than that of the output $Q_{722}$ and is fed to the other input terminal of the AND gate 65, and the output $Q_{722}$ is applied to the second input terminals of the AND gates 66 and 67. The outputs $Q_{723}$ and $Q_{724}$ are used to determine the alarming periods of the alarming sound. The output $Q_{723}$ has a period shorter than that of the output $Q_{724}$, and is fed to the third input terminal of the AND gate 66, and the output $Q_{724}$ is fed to the third input terminal of the AND gate 67. The output $Q_{725}$ determines the alarming period.

The outputs of the AND gates 65, 66 and 67 are fed to the input terminals of an OR gate 68, and the output of the OR gate 68 is amplified for its current by a buffer 69 to energize the alarming device.

Operations of each of the portions are further described below. First, in the initial state, let it be supposed that the outputs Q of the RS-FF's 62 to 64 are acquiring L level, the output $\overline{Q}$ of the D-FF 71 is acquiring H level, the outputs $Q_{721}$ to $Q_{725}$ of the frequency divider 72 are acquiring L level, and the frequency divider 72 and the D-FF 71 are reset by the signals of the H level fed to their input terminals R. The frequency divider 72 is also triggered by a breaking signal fed to the input terminal $\phi$. Here, if the time-keeping operation has proceeded and the alarm-setting time is reached, i.e., if the outputs of the OR gate 49, OR gate 51, OR gate 52 and OR gate 55 have turned into the L level, the output of the NOR gate 58 acquires the H level and the output of the AND gate 61 acquires the H level. The RS-FF 64 is then set and produces the output Q of the H level. This renders the AND gate 67 conductive. The OR gate 70 also produces the output of the H level which causes the D-FF 71 to be triggered to produce the output $\overline{Q}$ of the L level. The frequency divider 72 is then liberated from the reset state and commences its operation. Here, the AND gate 67 calls the outputs $Q_{722}$ and $Q_{724}$ from the frequency divider 72 and produces their product at the output terminal. The product is then fed to the OR gate 68 and is used as an alarming signal. This alarming signal has a period in synchronism with the output $Q_{724}$ and has a frequency equal to that of the output $Q_{722}$. Thereafter, either one of the output 150 of the switch C shown in FIG. 1 or the output $Q_{725}$ of the frequency divider 72 acquires the H level, causing the RS-FF 64 and the D-FF 71 to be reset and further causing the frequency divider 72 to be reset. Therefore, the alarming is finished. In the foregoing was mentioned the alarming operation set by the alarm setting mechanism 33. As the time-keeping operation further proceeds until just 20 seconds before the normal time, the output of the NOR gate 57 acquires the H level, and the output of the AND gate 60 acquires the H level thereby to set the RS-FF 63. The AND gate 66 is then rendered conductive, the output of the OR gate 70 acquires the H level, the D-FF 71 is triggered again, and the output $\overline{Q}$ is converted from the H level to the L level. The frequency divider 72 is liberated again from the reset state and commences its operation. Here, the AND gate 66 calls the outputs $Q_{722}$ and $Q_{723}$ from the frequency divider 72 and produces their product at the output terminal. The product is fed to the OR gate 68. The product which serves as an alarming output has a period in synchronism with the output $Q_{723}$ and a frequency equal to that of the output $Q_{722}$. Thereafter, either one of the output 150 of the switch C or the output $Q_{725}$ of the frequency divider 72 which has acquired the H level causes the RS-FF 63 and the D-FF 71 to be reset and further the frequency divider 72 to be reset, whereby the alarming is finished. In the foregoing was mentioned the alarming operation produced prior to the normal time by a predetermined period of time.

As the time-keeping operation further proceeds and reaches the normal time, the output of the NOR gate 56 acquires the H level, and the output of the AND gate 59 also acquires the H level. The RS-FF 62 is set, the output Q acquires the H level, the AND gate 65 is rendered conductive, the output of the OR gate 70 acquires the H level, the D-FF 71 is triggered again, and the output $\overline{Q}$ is converted from the H level into the L level. The frequency divider 72 is then liberated from the reset condition and commences its operation. Here, the AND gate 65 calls the output $Q_{721}$ from the frequency divider 72 and feeds its output to the OR gate 68 to produce the alarming. This is a continuous alarming output corresponding to the frequency of the output $Q_{721}$. Thereafter, either one of the output 150 of the switch C or the output $Q_{725}$ of the frequency divider 72 acquires the H level, causing the RS-FF 62 and D-FF 71 to be reset and further the frequency divider 72 to be reset, whereby the alarming is finished. In the foregoing was mentioned the operation of alarming at the normal time.

The normal-time output 403 is fed to the other input terminal of the OR gate 43 shown in FIG. 2. Therefore, as the normal-time output is produced, the presettable down counter 3 is preset again. This enables the stop watch to again measure the duration of time.

What is claimed is:

1. An electronic digital stop watch comprising: a time standard signal generator; a frequency divider for dividing the frequency of said time standard signal to form a time unit signal, means for keeping a time in accordance with the frequency of said time unit signal; alarm control means which comprises a presettable down counter, manually operable means for presetting a desired alarm time in said presettable down counter, means for detecting the relationship between the time kept in said time-keeping means and the alarm time set in said presettable down counter to generate an alarm signal, and an audible signal generator energized by said alarm signal; and a display device for indicating the time kept in said time-keeping means or the time preset in said presettable down counter.

2. The stop watch as defined in claim 1 wherein a comparator is connected to said presettable down counter so as to generate said alarm signal when the content of said time-keeping means becomes the value N times (N being an integer more than 1) the preset value.

3. The stop watch as defined in claim 1 wherein said comparator is connected to said presettable down counter so as to generate said alarm signal when the content of said time-keeping means becomes the predetermined value less than the value which is N times (N being an integer more than 1) the preset value.

4. The stop watch as defined in claim 1 wherein said comparator is connected to said presettable down counter so as to generate said alarm signal when the content of said time-keeping means becomes the predetermined value larger than the value which is N times (N being an integer more than 1) the preset value.

5. The stop watch as defined in claim 1 wherein said detector means is connected to said presettable down counter to generate a pre-alarm signal prior to the preset time by a predetermined period of time.

6. The stop watch as defined in claim 1 wherein said audible signal generator comprises a circuit for generating a plural types of alarm sound.

7. The stop watch as defined in claim 1 wherein the operation of said audible signal generator is stopped by the operation of said manually operable means.

8. The stop watch as defined in claim 1 wherein said audible signal generator operates to generate an alarm sound for the predetermined period of time.

9. An electronic digital stop watch comprising:

(a) a time standard signal generator providing a time standard signal, (b) a frequency divider circuit cor dividing the frequency of said time standard signal;

(c) a time keep circuit for counting the outputs from said frequency divider circuit;

(d) an alarm control circuit including an alarm setting circuit and a presettable down counter, said presettable down counter being previously set with the set contents of an alarm time which is set in said alarm control circuit in response to a manual operating means;

(e) a detection circuit generating a detection signal corresponding to an output of said presettable down counter;

(f) an audible signal generator generating an audible signal in response to an output of said detection circuit; and (g) a display device indicating the kept time in said time keep circuit and the alrm set time.

10. The stop watch as defined in claim 9 wherein said alarm control circuit further includes an inverter and an OR gate.

11. The stop watch as defined in claim 9 wherein said alarm setting circuit further includes a pre-alarm setting circuit for setting a pre-alarm alarm.

12. The stop watch as defined in claim 9 wherein said alarm control circuit operates to set an alarm time in response to a manual operating means.

13. The stop watch as defined in claim 9 wherein said presettable down counter functions to subtract in accordance with the operation of said time keep circuit.

14. An electronic digital stop watch comprising:

(a) a time standard signal generator providing a time standard signal;

(b) a frequency divider circuit for dividing the frequency of said time standard signal;

(c) a time keep circuit for counting the outputs from said frequency divider circuit;

(d) an alarm control circuit including an alarm setting circuit and a presettable down counter, said alarm setting circuit further including a pre-alarm setting circuit for setting a pre-alarm alarm;

(e) a detection circuit generating a detection signal corresponding to an output of said presettable down counter, said detection circuit generates each detection signal at an alarm setting and a pre-alarm setting in accordance with the output of said presettable down counter and the contents of said pre-alarm setting circuit;

(f) an audible signal generator generating an audible signal in response to an output of said detection circuit; and (g) a display device indicating the kept time in said time keeping circuit and the alarm set time.

15. The stop watch as defined in claim 14 wherein said audible signal generator generates different alarming sounds by each detection signal of said detection circuit corresponding to the alarm setting and the pre-alarm setting, respectively.

16. The stop watch as defined in claim 14 wherein a pre-alarm setting in said pre-alarm setting circuit generates a detection signal from said detection circuit when the contents of time keeping in said time keep circuit is always smaller than N (N=1, 2, 3 . . . ) times the alarm setting in the second alarm setting circuit.

17. The stop watch as defined in claim 14 wherein a pre-alarm setting in said pre-alarm setting circuit generates a detection signal from said detection circuit when the contents of time keeping in said time keep circuit is smaller then N (N=1, 2, 3 . . . ) times the alarm setting in the second alarm setting circuit by a third time set by said pre-alarm setting circuit.

18. An electronic digital stop watch comprising:

(a) a time standard signal generator providing a time standard signal;

(b) a frequency divider circuit for dividing the frequency of said time standard signal;

(c) a time keep circuit for counting the outputs from said frequency divider circuit;

(d) an alarm control circuit including an alarm setting circuit and a presettable down counter, said alarm setting circuit further including a pre-alarm setting circuit for setting a pre-alarm alarm;

(e) a detection circuit generating a detection signal corresponding to an output of said presettable down counter, said presettable down counter being reset to said alarm setting time by the alarm setting detection signal from said detection circuit;

(f) an audible signal generator generating an audible signal in response to an output of said detection circuit; and (g) a display device indicating the kept time in said time keep circuit and the alarm set time.

* * * * *